United States Patent [19]

Prascak et al.

[11] Patent Number: 4,982,845

[45] Date of Patent: Jan. 8, 1991

[54] RESEALABLE ENCLOSURE

[75] Inventors: Brian Prascak, Stamford; Todd Erickson, Danbury, both of Conn.

[73] Assignee: James River Corporation, Richmond, Va.

[21] Appl. No.: 367,568

[22] Filed: Jun. 19, 1989

[51] Int. Cl.[5] ..... B65D 81/24; B65D 45/00

[52] U.S. Cl. ..... 206/621; 206/631.1; 206/633; 206/624; 206/812; 206/813; 229/79; 229/81; 229/82

[58] Field of Search ..... 206/630, 628, 624, 625, 206/621, 620, 494, 812, 610, 601, 609, 631.1, 633; 229/79, 80, 81, 82

[56] References Cited

U.S. PATENT DOCUMENTS

| | | | |
|---|---|---|---|
| 2,574,345 | 11/1951 | Montgomery | 206/494 |
| 2,965,224 | 12/1960 | Harwood | 206/494 X |
| 3,265,283 | 8/1966 | Farquhar | 206/624 |
| 3,286,830 | 11/1966 | Robb, Jr. | 206/621 X |
| 3,761,012 | 9/1973 | Rosenburg, Jr. | 206/609 |
| 4,192,420 | 3/1980 | Worrell, Sr. et al. | 206/621 X |
| 4,420,080 | 12/1983 | Nakamura | 206/613 X |
| 4,610,357 | 9/1986 | Nakamura | 206/613 X |
| 4,651,874 | 3/1987 | Nakamura | 206/621 X |
| 4,709,399 | 11/1987 | Sanders | 206/633 X |
| 4,834,244 | 5/1989 | Masui | 206/609 |

FOREIGN PATENT DOCUMENTS

| | | | |
|---|---|---|---|
| 2706234 | 8/1978 | Fed. Rep. of Germany | 206/620 |

*Primary Examiner*—Paul T. Sewell
*Assistant Examiner*—Jacob K. Ackun, Jr.
*Attorney, Agent, or Firm*—Finnegan, Henderson, Farabow, Garrett & Dunner

[57] ABSTRACT

A resealable packaging enclosure is disclosed which includes a tear path defining an aperture through which products may be extracted from the enclosure, and a resealable closure tab which extends across the tear path. The tear path includes weaker and stronger portions. The stronger portion is more resistent than the weaker portion to forces tending to separate the material comprising the enclosure along the tear path. Thus, the tear path has a variable resistance along its length to forces tending to open the enclosure.

10 Claims, 2 Drawing Sheets

RESEALABLE ENCLOSURE

BACKGROUND OF THE INVENTION

1. Field of the Invention

The present invention relates to packaging enclosures for holding and protecting dispensible products, and more particularly, to resealable packaging enclosures.

2. Description of the Related Art

Typically, packaging enclosures which hold a large number of dispensible products, such as napkins or other sheet-like products, are opened once to initially retrieve the products from the enclosure, and remain open until the products are exhausted. In instances where these dispensible products are used intermittently by a consumer, the package may remain open for many months, thereby being subjected to moisture, dirt, or other environmental elements which might contaminate the products.

Also, bulk products such as the napkins mentioned above are often enclosed in a flexible wrapping material such as plastic film and are pre-compressed so as to reduce the package size. When a consumer opens the plastic film to retrieve the napkins, the plastic is typically ripped in a haphazard manner which may result in the napkins or other products spilling out of the packaging due to the precompression utilized to pack the napkins tightly within the packaging material.

There are known in the prior art flexible, resealable packaging enclosures which utilize a flap for resealing an aperture through which the products are dispensed. Typical of such packaging configurations is U.S. Pat. No. 4,192,420 to Worrell, Sr. et al. That patent discloses a pliable, moisture-impervious package configuration wherein the shape of a pivoting flap which covers an aperture is defined by perforations made in the packaging material. The flap is also coated with an adhesive on one side such that it may be attached to a separate portion of the packaging cover to reseal the aperture.

The present invention provides an improvement in the configuration and structure of resealable packaging enclosures such as described in Worrell, Sr. et al. One object of the present invention is to provide a resealable packaging enclosure which provides easy access to dispensible products contained within the enclosure.

It is further object of the present invention to provide a resealable packaging enclosure which can protect the contents of the enclosure from moisture, dirt, or other environmental elements to thereby reduce any risk of contamination of the products contained within the enclosure, even during lengthy storage.

It is still a further object of the invention to provide a resealable packaging enclosure which resists premature opening from forces exerted on the enclosure during shipping and handling, while simultaneously providing relatively easy access to the contents of the enclosure once in the hands of the consumer.

Additional objects and advantages of the invention will be set forth in the description which follows, and in part will be obvious from the description, or may be learned by practice of the invention. The objects and advantages of the invention may be realized and attained by means of the instrumentalities and combinations particularly pointed out in the appended claims.

SUMMARY OF THE INVENTION

To achieve the foregoing objects, and in accordance with the purposes of the invention as embodied and broadly described herein, a resealable enclosure for holding and protecting dispensible products is provided, comprising: a cover having a top panel, and means for defining a tear path in the top panel. The tear path forms an aperture through which products may be extracted from the enclosure. The defining means comprises stronger and weaker portions along the length of the tear path with the stronger portion being more resistant than the weaker portion to forces tending to separate the top panel along the tear path. Means are also provided for closing the aperture to reseal the enclosure.

In a first embodiment of the present invention, the stronger and weaker portions of the defining means comprise pluralities of perforations in the top panel. The perforations comprising the stronger portion may be spaced apart from one another by a distance greater than the spacing between the perforations comprising the weaker portions. Alternatively, the perforations comprising the stronger portions may be configured with lengths greater than the lengths of the perforations comprising the weaker portion.

In a second embodiment of the defining means, the top panel has a thickness and the stronger and weaker portions of the defining means comprise groove-like indentations formed in the cover. The indentations comprising the stronger portion being shallower in the direction of the thickness of the cover than the indentation comprising the weaker portion.

It is further preferable that the cover include a bottom panel and side panels extending between the top panel and bottom panel. The tear path then preferably extends from the top panel a predetermined distance down each side panel such that the aperture becomes generally U-shaped.

It is still further preferable that the closing means comprise a tab having first and second ends joined by a center portion. The first end is secured to the cover on one side of the tear path, and the second end is coated with an adhesive for releasably attaching to the cover on the opposite side of the tear path such that the central portion of the tab extends across the tear path to reseal the aperture.

BRIEF DESCRIPTION OF THE DRAWINGS

The accompanying drawings, which are incorporated in and constitute a part of the specification, illustrate preferred embodiments of the invention and, together with the general description given above and the detailed description of the preferred embodiments given below, serve to explain the principles of the invention.

DESCRIPTION OF THE PREFERRED EMBODIMENT

Reference will now be made in detail to the present preferred embodiment of the invention as illustrated in the accompanying drawings.

Figure 1:
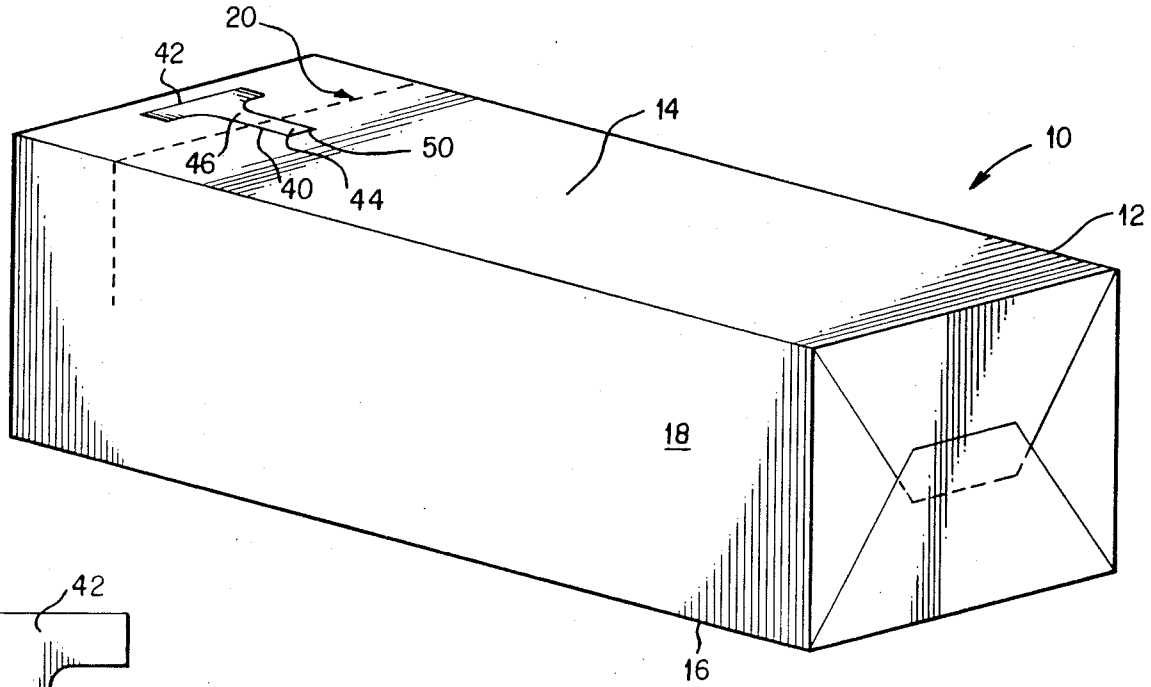
FIG. 1 is an isometric view of a resealable enclosure incorporating the teachings of the present invention.

FIG. 1 illustrates a resealable enclosure 10 incorporating the teachings of the present invention. Enclosure 10 is intended to hold and protect dispensible products such as napkins. The enclosure comprises a cover 12 which in a preferred embodiment is formed of flexible plastic material. By way of example and not limitation, a medium density polyethelene film having a nominal thickness of about 1.25 ml may be used. Such a film is manufactured by James River Corp., Advanced Films Division, New Castle, Del.

Cover 12 includes a top panel 14, a bottom panel 16 and side panels 18 extending between the top and bottom panels.

After loading enclosure 10 with dispensible products, the ends of the enclosure are folded and sealed in any conventional manner to thereby form the package of dispensible products.

In accordance with the present invention there is provided means for defining a tear path in the top panel. The tear path forms an aperture through which products may be extracted from the enclosure. The defining means comprises stronger and weaker portions along the length of the tear path with the stronger portion being more resistant than the weaker portion to forces tending to separate the top panel along the tear path. As embodied herein, the stronger and weaker portions of the defining means may comprise pluralities of perforations generally referred to as 20 formed in top panel 14 of enclosure 10.

The defining means may also extend a predetermined distance down each side panel 18 of enclosure 10. Preferably, the defining means extends approximately one half of the height dimension of side panel 18 such that the aperture formed by the tear path becomes generally U-shaped.

Figure 2:
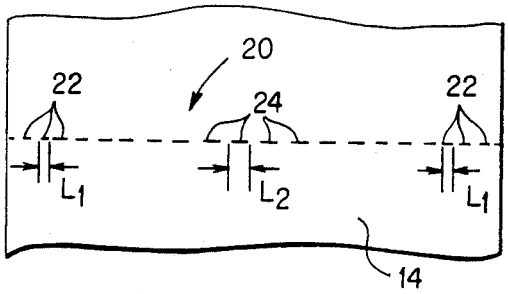
FIG. 2 is a partial plan view of the top panel of the enclosure of FIG. 1 which illustrates a first embodiment of the defining means.

With reference to FIG. 2, a first embodiment of the perforations comprising the defining means is illustrated. In this embodiment the stronger portion of the defining means comprises perforations 22 having a length $L_1$, and the weaker portion of the defining means comprises a plurality of perforations 24 each having a length $L_2$. Length $L_1$ is less than length $L_2$ and the distance between each perforation 22 and 24 is approximately equal. Thus, in that portion of the defining means comprised of perforations 24, less of the material comprising top panel 14 remains after the perforations are made. Similarly, in that portion of the defining means comprised of perforations 22, more of the material comprising top panel 14 remains after the perforations are made. Therefore, the portion of the tear path comprised of perforations 22 are stronger or more resistant to forces tending to tear the top panel along the tear path than the weaker portions of the tear path comprised of perforations 24.

It is to be understood that the perforations comprising the first embodiment of the defining means illustrated at FIG. 2 is not limited to first and second lengths $L_1$ and $L_2$. For instance, each of the perforations comprising the defining means may have a different length so long as the trend is such that the weaker portions of the defining means have perforations of a greater length than the stronger portions of the defining means.

Figure 3:
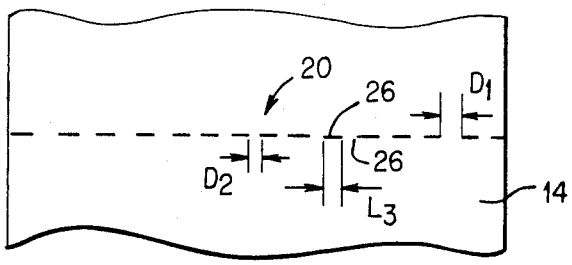
FIG. 3 is a partial plan view of the top panel of the enclosure of FIG. 1 which illustrates a second embodiment of the defining means.

With reference to FIG. 3, a second embodiment of the defining means is illustrated which again comprises a plurality of perforations 26 defining tear path 20. In this second embodiment of the defining means each perforation 26 is of a substantially equal length $L_3$, with the spacing between adjacent perforations 26 being greater in the stronger portion of the defining means than in the weaker portion of defining means. Specifically, spacing $D_1$ between perforations 26 at the outside edges of top panel 14 is greater than spacing $D_2$ between perforations 26 at the center of top panel 14. In this manner, less material of top panel 14 remains in the weaker portion of the defining means than in the stronger portion of the defining means after the perforations are made.

It should also be understood that the weaker and stronger portions of the defining means may also be comprised of a combination of the first and second embodiments illustrated in FIGS. 2 and 3. For instance, the length of the perforations in the stronger portion of the defining means may be less than the length of the perforations in the weaker part of the defining means, and may also be separated by a distance greater than the distance which separates the perforations in the weaker portion of the defining means.

Figure 4:
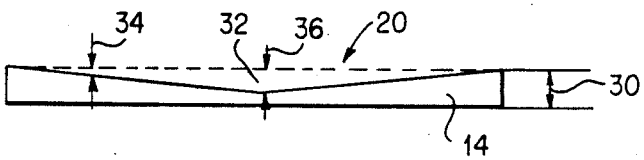
FIG. 4 is a cross-sectional view of the top panel which illustrates a third embodiment of the defining means.

A third embodiment of the defining means is illustrated in FIG. 4 which shows a cross-sectional view of top panel 14 taken along tear path 20. Top panel 14 has a thickness illustrated by arrow 30. In this embodiment of the defining means the stronger and weaker portions comprise a groove-like indentation generally referred to as 32 formed in top panel 14. Indentation 32 at the stronger portion of the defining means is shallower as shown by arrow 34 than the depth of the indentation at the weaker portion of the defining means as illustrated by arrow 36. In this manner, at the weaker portion of the defining means where indentation 32 is deeper in the direction of thickness of top panel 14, there remains less of the material comprising top panel 14 than at the stronger portions of indentation 32.

In instances where the tear path extends from top panel 14 down each of side panels 18, the trend characterizing the placement of the stronger and weaker portions in each of the above described first, second and third embodiments of the defining means is simply extended along each side panel.

Figure 5:
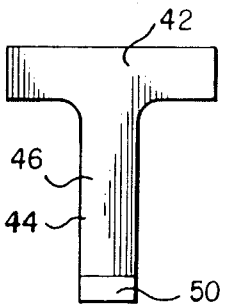
FIG. 5 is a detailed view of the tab illustrated in the view of the resealable enclosure shown in FIG. 1.

In accordance with the present invention there is also provided means for closing the aperture formed by tear path 20 to thereby reseal the enclosure. As embodied herein, the closing means comprises a tab 40 illustrated in detail in FIG. 5. Tab 40 has a first end 42, a second end 44 and a center portion 46 joining each of the first and second ends 42 and 44. First end 42 is secured to the outer surface of top panel 14 on a first side of tear path 20. In the preferred embodiment of the present invention, first end 42 of tab 40 may be coated on its bottom side with an adhesive which facilitates attachment of first end 42 to the outer surface of top panel 14. This adhesive coating is also placed on the bottom side of center portion 46 and on the bottom side of second end 44. Then, to reseal the aperture defined by tear path 20, second end 44 of tab 40 is pulled across to the opposite side of the aperture and adhesively fixed to top panel 14. Preferably, tab 40 is centered on top panel 14 such that center portion 46 extends across the weaker portion of the defining means when the enclosure is resealed. Also, it is preferable that the distal most portion 50 of second end 44 be free of adhesive so that it may be easily gripped by a consumer to open and reseal the enclosure.

In a preferred embodiment of the present invention the inventors have used K3 adhesive manufactured by Avery Labels International of Azusa, Calif., as the detachable adhesive applied to the bottom of tab 40. While the same adhesive may be used over the entire bottom of tab 40 (except end 50), in an alternative embodiment different adhesives may be used on different portions of tab 40, such as, for example, a non-releasable adhesive at first end 42 and releasable and resealable adhesive at center portion 46 and second end 44.

The combination of defining means comprised of stronger and weaker portions, and a closing means which is disposed to extend across the weaker portion of the defining means, provides significant advantages over the prior art. Specifically, during transportation and storage the resealable closing tab reinforces the weaker portion of the defining means such that the package does not inadvertently open if subjected to rough handling. Furthermore, once in the hands of the consumer, the package may be opened by grasping the distal gripping portion 50 of tab 40 and pulling back. The force exerted on the film 12 by the adhesive coating on tab 40 acts to initiate separation of top panel 14 along tear path 20. This initial separation is continued outwardly from the weaker portion of the tear path to the stronger portions on either side thereby avoiding indiscriminate ripping of film 12. The enclosure may be resealed simply by pulling film 12 together at tear path 20 and reattaching the adhesive side of second end 44 of closure tab 40 to top panel 14.

It is also preferable that tab 40 be comprised of an adhesive tape having a poly-laminate outer surface thereby minimizing the risk that the closure tab will rip during use.

Additional advantages and modifications will readily occur to those skilled in the art. Therefore, the invention in its broader aspects is not limited to the specific details, representative devices, and illustrative examples shown and described. Accordingly, departures may be made from such details without departing from the spirit or scope of the general inventive concept as defined by the appended claims and their equivalents.

What is claimed is:

1. A resealable enclosure for holding and protecting dispensable products, comprising:

a cover having a top panel, said top panel having side edges and a central portion intermediate said side edges;

means defining a tear path in said top panel, said tear path having a width which extends across said central portion of said top panel to form an aperture through which products may be extracted from the enclosure, said defining means having a weaker portion where said tear path intersects said central portion of said top panel and stronger portions on either side of said weaker portion proximate said side edges, said stronger portions being more resistant than said weaker portion to forces tending to separate said to panel along said tear path; and a closure tab having a first end permanently secured to said top panel on one side of said tear path, and a second end having an adhesive coating facilitating releasable attachment of said second end facilitating releasable attachment of said second end to said top panel on the opposite side of said tear path to close said aperture, said second end of said closure tab having a width substantially less than the width of said tear path, such that said second end attaches to said top panel in a region of said weaker portion of said defining means.

2. The enclosure of claim 1, wherein said stronger portions and weaker portion of said defining means comprise respective pluralities of perforations in said top panel.

3. The enclosure of claim 1, wherein said perforations comprising said stronger portion are spaced apart from one another by a distance greater than a spacing between said perforations of said weaker portions.

4. The enclosure of claim 1, wherein said perforations comprising said weaker portion have a length greater than a length of the perforations comprising said stronger portions.

5. The enclosure of claim 1, wherein said top panel has a thickness and said stronger portions and weaker portion of said defining means comprise a groove-like indentation formed in said top panel, said stronger portions of said indentation being shallower in the direction of said thickness than said weaker portion of said indentation.

6. The enclosure of claim 1, wherein said cover includes a bottom panel and side panels extending between said top panel and said bottom panel, and said tear path extends from said top panel a predetermined distance down each side panel such that said aperture becomes generally U-shaped.

7. The enclosure of claim 1, wherein said tab is substantially T-shaped.

8. The enclosure of claim 1, wherein said second end of said tab includes a grip portion substantially free of adhesive.

9. The enclosure of claim 1, wherein said tab is disposed such that the second end thereof extends across the weaker portion of said defining means when said second end is attached to the top panel.

10. The enclosure of claim 1, wherein said tab is formed of tape having an adhesive applied on one side and a poly-laminate applied on the opposite side.

* * * * *

UNITED STATES PATENT AND TRADEMARK OFFICE

CERTIFICATE OF CORRECTION

PATENT NO. : 4,982,845

DATED : January 8, 1991

INVENTOR(S) : Brian Prascak, Todd Erickson

It is certified that error appears in the above-identified patent and that said Letters Patent is hereby corrected as shown below:

Claim 1, column 6, lines 10-11, delete "facilitating releasable attachment of said second end".

Signed and Sealed this

Eleventh Day of February, 1992

*Attest:*

*Attesting Officer*

HARRY F. MANBECK, JR.

*Commissioner of Patents and Trademarks*